United States Patent [19]

Blissett et al.

[11] Patent Number: 4,866,860

[45] Date of Patent: Sep. 19, 1989

[54] METATARSAL HEAD SHOE CUSHION CONSTRUCTION

[75] Inventors: Malcolm G. Blissett, Grand Rapids; Brian C. Goodliffe, Rockford, both of Mich.

[73] Assignee: Wolverine World Wide, Inc., Rockford, Mich.

[21] Appl. No.: 224,119

[22] Filed: Jul. 25, 1988

[51] Int. Cl.[4] ..... A43B 13/18

[52] U.S. Cl. ..... 36/28; 36/25 R

[58] Field of Search ..... 36/28, 30 R, 25 R, 31, 36/45, 88

[56] References Cited

U.S. PATENT DOCUMENTS

| | | | |
|---|---|---|---|
| 53,523 | 3/1866 | Coburn | 36/30 R |
| 1,244,197 | 10/1917 | Gustin | 36/28 |
| 1,336,979 | 4/1920 | Plummer | 128/619 |
| 1,481,133 | 1/1924 | Grossman | 128/621 |
| 1,841,942 | 1/1932 | Fenton | 128/586 |
| 1,850,309 | 3/1932 | Thoma | 36/38 |
| 2,055,574 | 9/1936 | Hartl | 36/44 |
| 2,058,975 | 10/1936 | Gray | 36/44 |
| 2,061,540 | 11/1936 | Macdonald et al. | 36/8.5 |
| 2,081,226 | 5/1937 | Cocozella | 12/142 |
| 2,107,620 | 2/1938 | Rigandi | 36/71 |
| 2,126,601 | 8/1938 | Bain | 12/142 |
| 2,139,260 | 12/1938 | Cuozzo | 12/146 |
| 2,182,042 | 12/1939 | Timson | 12/142 |
| 2,207,437 | 7/1940 | Marks et al. | 12/142 |
| 2,257,343 | 9/1941 | Kilburn | 36/12 |
| 2,401,088 | 5/1946 | Lumbard | 36/30 |
| 2,405,443 | 8/1946 | Mees | 36/30 |
| 2,410,530 | 11/1946 | Strong | 36/30 |
| 2,502,774 | 4/1950 | Alianiello | 36/28 |
| 2,523,702 | 9/1950 | La Chapelle | 36/28 |
| 2,785,480 | 3/1957 | Maccarone | 36/2.5 |
| 3,086,301 | 4/1963 | Pastor | 36/2.5 |
| 3,641,688 | 2/1972 | von den Benken | 36/43 |
| 4,227,320 | 10/1980 | Borgeas | 36/88 |
| 4,316,332 | 2/1982 | Giese et al. | 36/28 |
| 4,364,188 | 12/1982 | Turner et al. | 36/31 |
| 4,519,147 | 5/1985 | Jones, Jr. | 36/19.5 |
| 4,697,361 | 10/1987 | Ganter et al. | 36/28 |

FOREIGN PATENT DOCUMENTS 1084290 1/1955 France .

OTHER PUBLICATIONS

"The Running Shoe Book", Peter R. Cavanagh, Ph.D., copyright 1980 including Chapter 5—How Running Shoes are Made, pp. 96–136; Chapter 8—Gimmicks or Greatness, pp. 157–185; and Chapter 12—Inserts, Arch Supports, and Orthotics, pp. 241–260.

*Primary Examiner*—Werner H. Schroeder
*Assistant Examiner*—D. Biefold
*Attorney, Agent, or Firm*—Price, Heneveld, Cooper, DeWitt & Litton

[57] ABSTRACT

A shoe construction is disclosed including a flexible forefoot portion having no rigid parts and which cushions the metatarsal head area of the foot when in use. A resilient memory pad, preferably of foam material, is positioned in an aperture formed in the metatarsal head support area in the bottom of the forepart of a force lasted shoe upper under a thin cover sewn around the aperture edges. The memory pad engages the top surface of an outsole. The memory pad and cover are compressible by the foot to the thickness of the upper bottom so that no protrusion or discomfort results when the foot is bearing weight. The outside bottom includes a molded pad, preferably of thermoplastic rubber, below and aligned with the memory pad for improved traction, gripping, wear resistance and cushioning. Various rear part constructions may be used including cement lasted assemblies.

43 Claims, 3 Drawing Sheets

METATARSAL HEAD SHOE CUSHION CONSTRUCTION

BACKGROUND OF THE INVENTION

This invention relates to shoe constructions for the human foot and, more particularly, to shoe constructions which are soft and flexible in their forepart while providing overall support and stability for the entire foot with both internal and external cushioning which does not infringe on the fit of the foot in the interior of the shoe.

Soft, flexible shoes providing increased foot comfort have long been desired. In the past, many constructions and designs for such shoes have been tried with varying results. Several prior known shoes have incorporated pads in the forefoot, instep or heel areas. Many of those pads provide little or no feeling of comfort when weight is taken off the foot since they are recessed in the midsole or outer sole and do not adequately enclose the recesses of the foot, especially in the weight bearing metatarsal head support area or ball of the foot. With other pads, when weight is pressed onto the foot, the wearer either feels the protruding pad forming a lump under the matatarsal head area or the edges from the support material surrounding the pad. In either case, discomfort resulted.

A concurrent problem with shoes of a soft, flexible construction is the inability to adequately cushion the weight bearing metatarsal head area and heel areas of the foot from the protrusion of objects through the outsole. Stones, gravel, sticks and the like all cause pressure on impact in such areas through the outsole when weight is pressed onto the foot. The thinner, less substantial nature of the prior known soft, flexible shoe constructions could allow bruising of the foot or other discomfort.

A further problem with soft, flexible shoes is the slipping encountered in use, especially on wet or smooth surfaces. Prior known, lightweight, flexible shoes traditionally provide less support, often in the sole area because of lesser tread and rigidity. This results in a greater chance of slippage especially on the above type surfaces.

Accordingly, a soft, flexible yet stable shoe construction was desired which overcomes the above and other problems.

SUMMARY OF THE INVENTION

The present invention was conceived as a solution to the above and other shoe problems and provides an improved shoe construction including a flexible forefoot portion having no rigid parts which cushions the metatarsal head weight bearing area of the foot when in use without infringing on the fit of the foot in the interior of the shoe. The present construction likewise cushions the weight bearing areas of the foot from the impact of objects through the outsole with an outsole pad or pads also providing increased traction, gripping and wear resistance while cushioning under the metatarsal head area and/or heel areas.

In one form, the invention is a shoe construction for the human foot including an outsole, a shoe upper portion secured to the outsole and having a rear part adapted to extend along the sides and heel area of the foot and a forepart extending over and along the toes of the foot. The forepart material extends downwardly and inwardly from the sides and toe areas and forms an upper bottom extending under the entire forepart which is adapted to overlie the forepart of the outsole. The upper portion also includes an aperture in the forepart upper bottom in the area of the shoe adapted to support the metatarsal heads of the foot. Memory pad means formed from resilient, compressible material are located in the aperture and engage the upper surface of the outsole for supporting the metatarsal head area of the foot. Insole means overlie the upper bottom and memory pad means for supporting and engaging the foot as well. In this construction, the forepart upper bottom has a predetermined first thickness in the area surrounding the aperture while the memory pad has a second thickness greater than the first thickness and projecting above the forepart upper bottom in the surrounding area when uncompressed. The memory pad means are compressible by weight on a foot to a third thickness substantially similar to the first thickness.

Preferably, a thin flexible cover is secured over the aperture to the upper bottom surrounding the aperture. The cover supports the upper bottom around the aperture during force lasting and provides an area to which the memory pad is adhered.

In other aspects of the invention, a shoe construction for the foot is provided including an outsole, a force lasted upper portion secured to the outsole and having a forepart, a rear part and an upper bottom in at least the forepart, memory pad means extending through the forepart upper bottom for supporting the metatarsal heads of the foot, the memory pad means engaging the upper surface of the outsole. In addition, a first outsole pad means is provided in the bottom surface of the outsole below the memory pad means for improving traction, gripping and wear resistance during walking when the shoe is worn while cushioning the impact of the foot on objects under the outsole.

Preferably, a pair of outsole pads are included, one under the metatarsal head area generally comparable in configuration to and aligned with the resilient memory pad, and one on the heel. The outsole pads are preferably formed from a thermoplastic rubber as is the remainder of the outsole which is molded therearound. The pads include a tread configuration different from the tread configuration on the remainder of the forward part of the outsole bottom surface.

Various rear part constructions may be used in conjunction with the flexible forepart of the present shoe invention. For example, a cement lasted rear part may be included. Alternately, the rear part may include marginal portions from the side and heel areas drawn together and sewn in the waste area of the shoe to form an upper bottom for the rear part. In the cement lasted version, a stiffener is employed to provide added support in the rear part. The stiffener is at least partially located by a recess in the outsole. In addition, a foam insole may be adhered over the entire upper bottom of the shoe and include a thin leather or other sock liner incorporating air circulation holes for moisture evaporation.

Accordingly, the present invention provides a unique, soft, flexible shoe forepart which may be used with varying types of rear part constructions. The flexible forepart provides increased comfort by providing a cushion under the metatarsal head area which neither overly protrudes nor overly compresses under weight but rather compresses to the thickness matching or flush with the surrounding upper bottom thickness in the forepart area to avoid discomfort during use. In addition, molded, thermoplastic outsole pads are positioned under the metatarsal head support area and on the heel and include different tread configuration to improve traction, gripping, wear resistance and cushioning during use.

These and other objects, advantages, purposes and features of the invention will become more apparent from a study of the following description taken in conjunction with the drawings.

DESCRIPTION OF THE PREFERRED EMBODIMENTS

Figure 1:
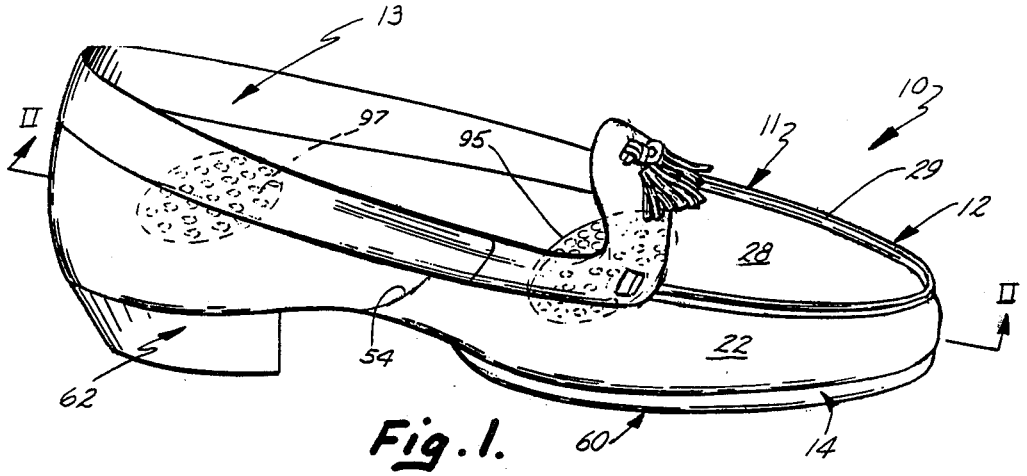
FIG. 1 is a perspective view of a preferred first form of the shoe construction of the present invention embodied in a moccasin-type shoe.

Referring now to the drawings in greater detail, FIG. 1 illustrates a first embodiment 10 of the shoe construction of the present invention. Shoe 10 includes an upper portion 11 which is preferably force lasted as explained below and having a forepart 12 and rear part 13. A full length outsole 14, preferably molded from a thermoplastic rubber material, is adhered to the underside of the upper 11. A memory pad assembly 16 is included at the metatarsal head support area of the foot while outsole pads 18, 20 are incorporated in the outsole bottom. The various elements of shoe 10 cooperate to provide a soft, flexible forepart which cushions the foot in use while maintaining a precise, stable and comfortable fit for the foot within the shoe.

Figure 4:
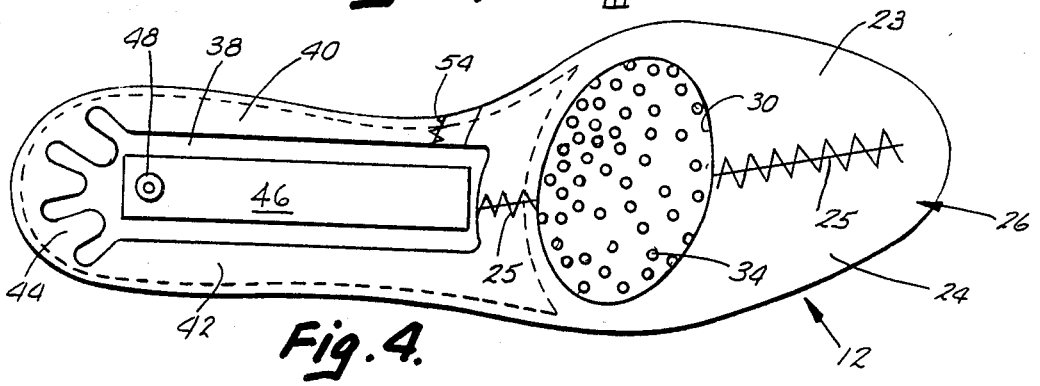
FIG. 4 is a bottom view of the bottom of the shoe upper portion in the shoe construction of FIGS. 1–3 and incorporating a cement lasted rear part.
Figure 5:
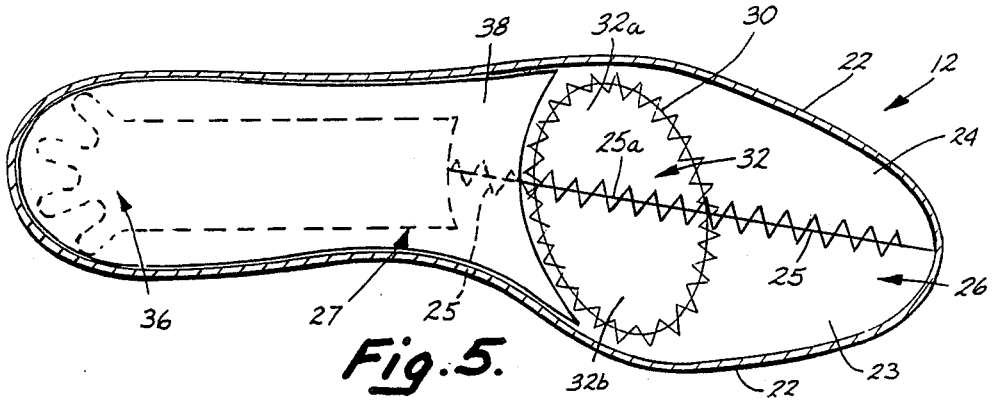
FIG. 5 is a sectional plan view taken along plane V—V of FIG. 2 showing the inner surface of the upper bottom with the insole removed.

As is best seen in FIGS. 2–5, the forepart 12 of shoe upper 11 is typically cut in one piece from soft, supple leather, pigskin or the like and includes sides 22 extending along the ball of the foot and toes, around the tips of the toes, and rearwardly along the sides of the arch of the foot and the heel area. Lower margins 23, 24 of sides 22 of forepart 12 of the shoe upper extend inwardly toward one another as shown in FIGS. 4 and 5 where they abut one another along a central seam or butt joint 25 which is sewn together with a throw stitch. When sewn in this manner, lower margins 23, 24 form a continuous upper bottom 26 which extends from the tips of the toes rearwardly past the metatarsal head support area or ball of the foot to a position under the forward part of the arch of the foot in the waist area 27 of shoe 10. The top 28 of forepart 12 is formed by an instep piece sewn around the upper edge 29 of sides 22 as shown in FIG. 1.

Figure 11:
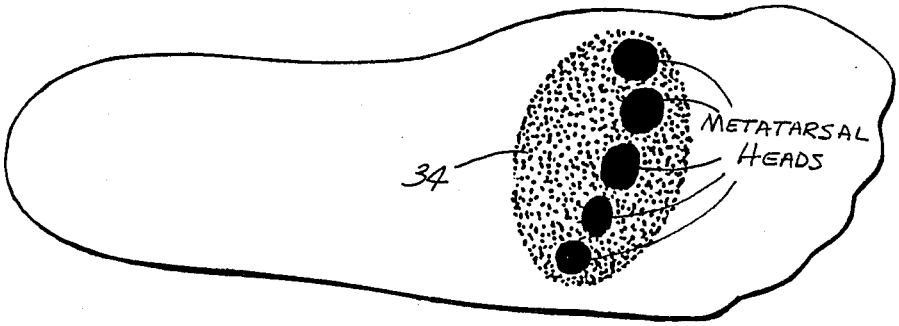
FIG. 11 is a plan view of the foot illustrating the metatarsal head weight bearing support area and the five metatarsal bone heads in that area.

In order to provide a place for insertion of the memory pad assembly 16, an oval or elliptical aperture 30 is cut in the upper bottom 26 at the area which supports the metatarsal bone heads when the foot is received in the shoe as shown in FIG. 11. Fitted and secured within aperture 30 prior to the sewing of butted seam 25 is a two-part cover 32 formed from a thin, flexible woven material such as cotton drill. Cover 32 is formed in two pieces and sewn to the edge of aperture 30 with a throw stitch by first sewing one half **32*a* of the cover to the left half or margin 24 of upper bottom 26 followed by the sewing of the right half 32*b* of the cover to the right half 23 of the upper bottom. Butted seam 25 extends through cover 32 at 25*a* and is formed when cover portions 32*a*, 32*b* are abutted upon joinder of upper bottom portions 23, 24 and sewn with a throw stitch. Hence, after stitching, bottom 26 of upper 11 in forepart 12 extends from the toe area rearwardly to a position rearward of the metatarsal head support area. Woven cover 32 typically has a thickness of about 0.7 to 0.8 mm and is thinner than the remainder of the upper bottom 26** which has a typical thickness within the range of 1.8 to 2 mm.

Figure 2:
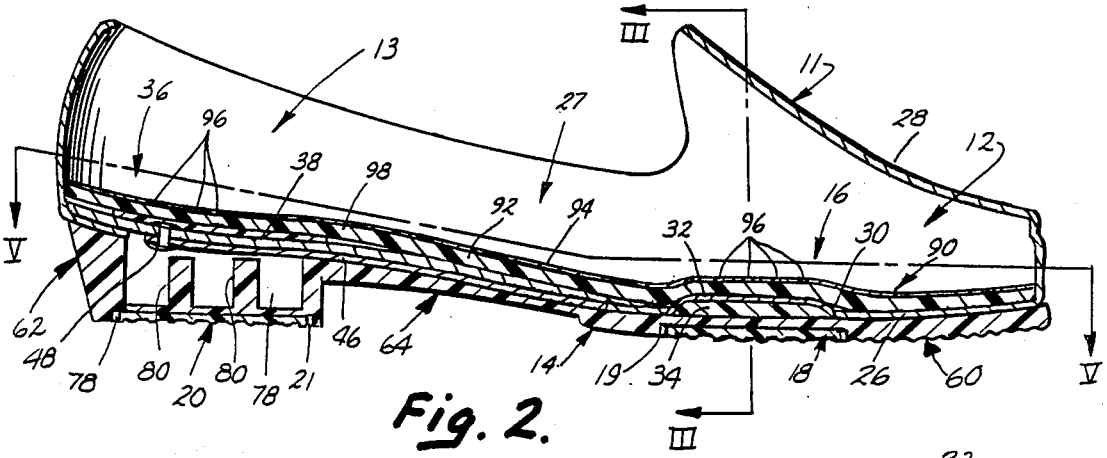
FIG. 2 is a sectional, side elevation of the shoe construction of the present invention taken along plane II—II of FIG. 1.
Figure 3:
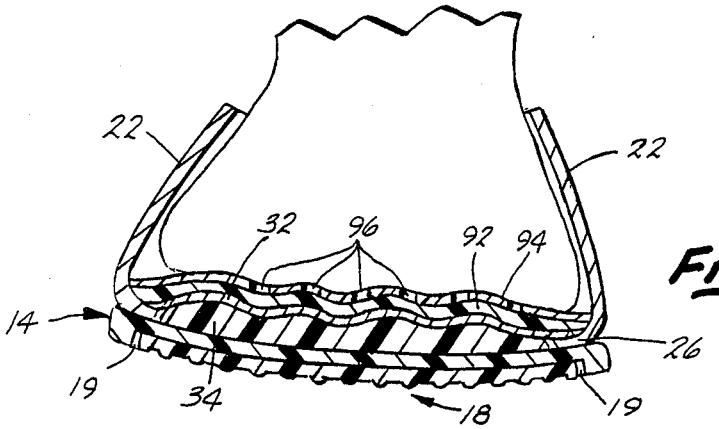
FIG. 3 is a sectional, front elevation taken along plane III—III through the metatarsal head support area of the uncompressed shoe construction shown in FIG. 2, the shoe receiving a foot therein.

As is also shown in FIGS. 2–4, memory pad 34 is cut in an oval or elliptical shape to match the outline and contour of aperture 30 from a flexible, resilient, breathable, polymeric foam material such as super density polyurethane sold under the trademark Poliyou by Kun Chyang Enterprise Company of Taipei, Taiwan R.O.C. Memory pad 34 has a uniform thickness of approximately 4 mm in the preferred embodiment, a hardness of 10 (ASKERC), a water vapor permeability of 10 $cm^2$ per hour and a compression set thickness loss of 14 to 25% as well as odor absorbing qualities. Memory pad 34 is adhered to the undersurface of cover 32 after upper bottom 26 is sewn together in the manner described above with a suitable cement or adhesive compatible with foam pad 34 and cover 32. In the assembled shoe, pad 34 engages the upper surface of outsole 14 and, since it has approximately twice the thickness of the surrounding upper bottom 26, will protrude approximately 2 mm above the upper bottom 26 in the preferred embodiment. However, the combination of cover 32 and pad 34 is compressible in the preferred embodiment to a thickness of approximately 2 mm such that it is matched or flush with the surrounding upper bottom 26 when bearing the weight of the body through a foot received in the shoe.

Also with reference to FIGS. 2–5, rear portion 13 of shoe upper 11 may be manufactured with one of various types of shoe constructions providing stiffness and support in waist area 27 and heel area 36 of shoe 10. As is best seen in FIGS. 4 and 5, sides 22 extend rearwardly from the forepart 12 along the sides of the arch and heel of the foot. The lower marginal edges 40, 42 of sides 22 in rear part 13 extend downwardly and inwardly and are secured by a suitable cement or adhesive in a cement lasted construction to a preformed piece of stiff, pressed fiberboard or hardboard 38 known as a seat board or tuck board. Thus, lower margin 40 on the inside of upper 11 is wrapped under and cemented to the inside undersurface of seat board 38 while the outer margin 42, extending downwardly from the outer side 22 of the shoe upper, is cemented to the outer underside of seat board 38. Likewise, the marginal portions 44 extending downwardly from the heel area 36, are folded inwardly and cemented to the underside of the heel of seat board 38. Seat board 38 is rounded at the heel portion and widens in a curved area while tapering and thinning out at its forward portion where it ends just behind the ball of the foot or metatarsal head support area. Seat board 38 provides stiffness and rigidity and thus stabilizing support for the shoe in the finished construction.

Preferably, seat board 38 is formed from pressed fiberboard of cellulose or the like available from Shengfa Enterprises Co. Ltd. of Taiwan having a thickness of 1.75 mm (±0.05 mm), an extension strength of 45 $Kg/cm^2$ (±3 $Kg/cm^2$) and a hardness of 90° (±5°). Seat board 38 absorbs moisture yet holds its shape and rigidity even when moist as occurs from perspiration within a shoe when worn.

Preferably, as shown in FIGS. 2 and 4, a metal reinforcing or stiffening strip 46 is secured to the underside of seat board 38 in the center of the seat board in order to add additional stiffness and support rigidity for the shoe. In order to prevent movement of the stiffening strip in the final shoe construction, the rear end of strip 46 is typically mechanically attached with rivet 48 at heel 36 of the seat board, while the forward end of metal strip 46, which extends to a position behind the metatarsal head support area, is typically cemented or adhered to the underside of seat board 38 in the arch or waist area 27 of the shoe. As will be explained below in connection with FIG. 7, a recess 84 may be provided in the upper surface of outsole 14 to receive, locate and retain metal stiffening strip 46 in position.

Figure 8:
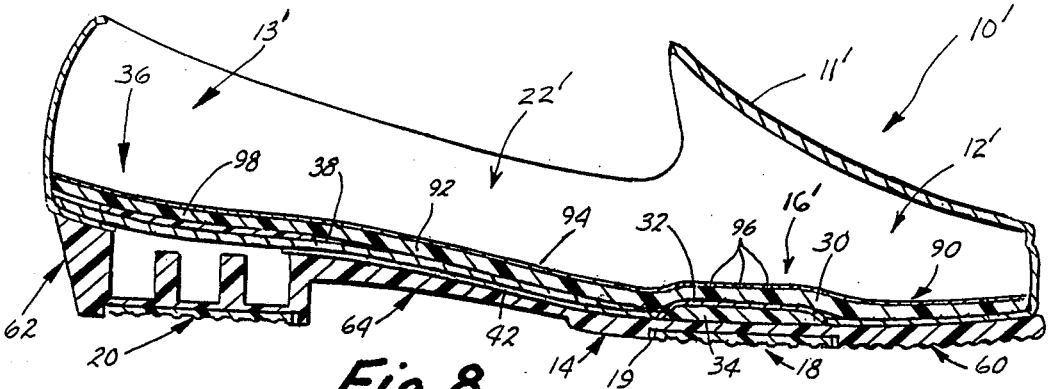
FIG. 8 is a sectional side elevation of an alternate shoe construction incorporating a metallic stiffening strip in the rear part of the shoe.

As shown in FIG. 8, an alternate construction 10' of the shoe, in which like numerals indicate like parts, is similar in all respects to shoe 10 but omits the metal stiffening strip 46 on the underside of seat board 38. As in shoe 10, the lower margins 40, 42 of upper sides 22 underlie seat board 38 and engage top surface 76 of outsole 14 although the central area under seatboard 38 has a small gap or space between it and the outsole.

Figure 9:
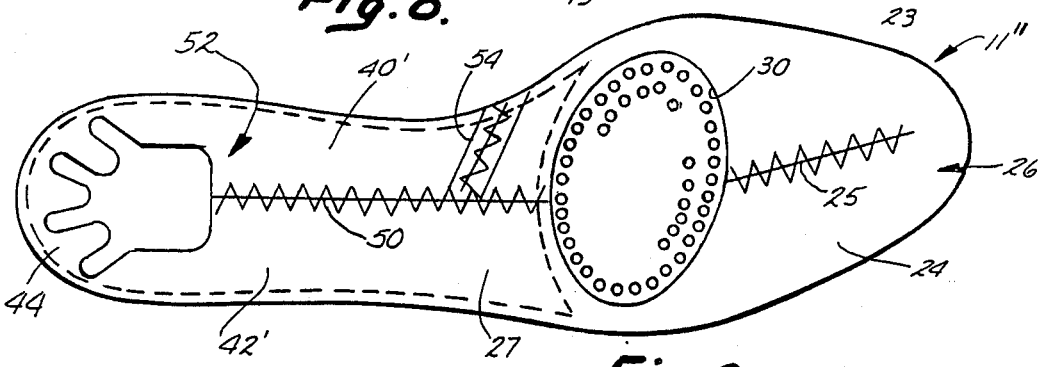
FIG. 9 is a bottom plan view of an alternate shoe upper portion useful in the present invention incorporating a different rear part construction.

Another alternate construction 11' for rear part of shoe upper is shown in FIG. 9. In this version, useful with full wedge-type shoes or "flats" which are entirely flat and do not include any raised heel area, the marginal portions 40', 42', extending downwardly and inwardly from sides 22 of shoe upper in rear part 13, extend inwardly to and abut one another along a central seam or butt joint 50 where they are sewn with a throw stitch to retain them together. Thus, joined margins 40', 42' define an upper bottom 52 in rear part of shoe upper 11" generally under the arch of the foot in the waist area 27 of the shoe. In this version, no seat board or other stiffener or rigid part is used inside the rear part bottom 52.

In each embodiment of the upper 11, 11' or 11", sides 22 are typically cut in one piece and joined at a single seam 54 extending downwardly and inwardly from the top of the inside side to the marginal edge of that side as shown in FIGS. 1, 4 and 9.

Figure 6:
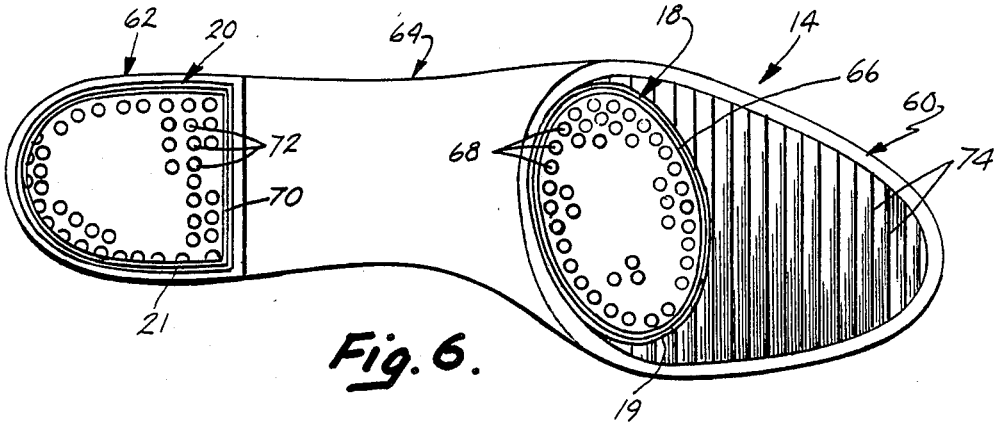
FIG. 6 is a bottom plan view of the outsole of the shoe construction of FIGS. 1–5.
Figure 7:
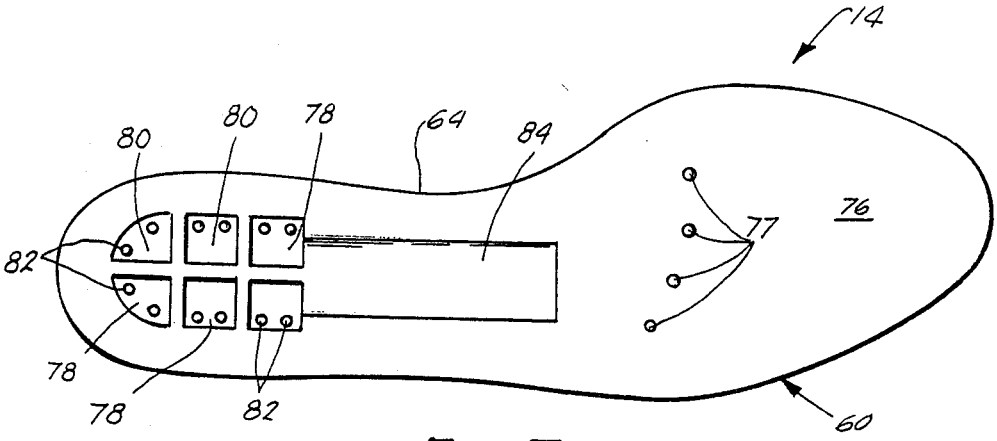
FIG. 7 is a plan view of the upper surface of the outsole of the shoe construction of FIGS. 1–5.

Referring now to FIGS. 6 and 7, outsole 14 includes foresole area 60, heel area 62 and a waist area 64 which is recessed from the level of the foresole 60 and downwardly extending heel 62. As mentioned above, outsole 14 includes a pair of outsole pads or inserts 18, 20 which provide traction, gripping and wear resistance while cushioning the foot in the completed shoe. As is best seen in FIG. 6, forward or foresole outsole pad 18 is formed in an oval or elliptical configuration substantially similar in configuration to memory pad 34. Pad 18 is injection molded from a thermoplastic rubber preferably fromed from a composition of 60% butadiene and 40% styrene. Pad 18 has an oval rim 66 and a plurality of partially spherical-shaped protrusions 68 extending downwardly to form a pebble-grain surface for increased traction and wear resistance under the ball of the foot or metatarsal head support area in the outsole, especially on wet or smooth surfaces.

Heel pad 20 is similar to metatarsal head support pad 18 but formed in the shape of heel 62 of outsole 14 and includes an outer rim 70 and a plurality of partially spherical protrusions 72. Heel pad 20 thus has a pebble-grain surface like that of pad 18 for improved traction and wear resistance.

The remainder of outsole 14 is injection molded from the same thermoplastic rubber material as pads 18, 20. Pads 18, 20 are used as preformed inserts fitted within the mold cavity for forming outsole 14 prior to injection of the rubber required for the remainder of the outsole. The mold also preferably includes small ridges or walls surrounding the outer sides or margins of pads 18, 20 to create slight spaces 19, 21 between the pad sides and the remainder of the outsole as shown best in FIGS. 2, 3, 6, 8 and 10. Such space allows the remainder of the completed outsole to flex away from pads 18, 20 thus allowing the pads to stay in better surface gripping position under the foot. The completed outsole includes a different tread 74 in the forward portion of foresole 60 from the pebble-grain surface on pads 18, 20. Preferably, tread 74 includes a plurality of shallow, parallel ridges extending laterally across the outsole to form a ripple-sole which is effective in gripping various surfaces for traction and slippage prevention when walking, especially wet and smooth surfaces.

On the opposite side of outsole 14 from the bottom surface where pads 18, 20 and ripple surface 74 are located is the upper surface 76 of outsole 14 which is adapted to be adhered or cemented to the underside of completed shoe upper 11, 11' or 11". As shown in FIG. 7, upper surface 76 of forepart 60 of the outsole 14 includes a series of small apertures receiving locating studs on the upper side of preformed metatarsal head outsole pad 18. The downwardly extending heel area 62 on the outsole includes hollow recesses 78 separated by support walls 80 which reduce heel weight without sacrificing strength. In addition, small apertures 82 receiving locating studs from the upper side of heel pad 20 are included in the heel portion. Intermediate waist portion 64 between the forepart and heel includes a recess 84 for receiving the metal stiffening strip 46 secured to the underside of seat board 38 as described above.

As is best seen in FIGS. 2, 3 and 8, the final portion of the shoe construction is insole 90 which extends the full length of the interior of the shoe from the tip of the toe to the heel. Insole 90 includes a full length foam pad, sock foam liner 92 formed from the same super density polyurethane, flexible, resilient, breathable foam as memory pad 34. Foam layer 92 typically has a thickness of 3 mm in the preferred embodiment and extends up and over memory pad and cover assembly 16 as shown in FIGS. 2 and 8. Adhered to the top surface of foam layer 92 is a sock liner 94 formed from a thin layer of leather and extending the full length of sock foam 92. Sock liner 94 includes air circulation or breathing holes 96 extending through the thickness of the sock liner in oval areas 95, 97 aligned and in registry with the memory pad assembly 16 and over the heel area 36 as shown in FIG. 1. Air holes 96 allow air circulation and evaporation of moisture from foam layer or sock foam 92, seat board 38, memory pad and cover 34, 32 respectively, and upper bottom 26, 52.

As is best seen in FIGS. 2 and 8, an additional layer of sock foam 98 is positioned in a teardrop shape under the heel portion of sock foam 92 at heel area 36 over seat board 38 to provide additional heel cushioning. Preferably, additional heel pad 98 has a thickness of approximately 1.5 mm. Although insole 90 is not necessary for actual functioning of the shoe construction 10 or 10', it does add comfort for the wearer and prevent abrasion and wear on socks worn in the shoes.

Preferably, sock liner 94 is formed from leather and has a thickness of 0.8 to 1.0 mm. Sock liner 94 is purposely kept quite thin to allow proper feel of the memory pad 34 for comfort. The desire is to provide the minimum amount of material to line the shoe and the maximum amount of material which is allowable for comfort purposes.

Completion of the manufacture of the shoe construction of the present invention will now be understood. After shoe upper 11 is cut in one piece and sewn together as described above including instep piece 28, cover portions **32*a*, 32*b* and upper bottom 26, the shoe upper is formed and shaped by inserting a shoe last or form in upper forepart 12. Since forepart 12 is typically slightly undersized after sewing, the shoe last must usually be "forced" into the interior of the forepart providing the process with the name "force lasting". Such insertion sizes the forepart and provides it with its ultimate shape. During such insertion, the stitching of cover 32 to the surrounding edge of aperture 30 in upper bottom 26 supports and strengthens upper bottom and prevents that bottom from tearing or pulling apart and prevents aperture 30** from elongating.

After insertion of the shoe last in the shoe forepart, seat board 38 is slipped between the bottom of the shoe last and upper bottom 26 such that it is retained along the underside of the shoe last. Thereafter, marginal portions 40, 42 and heel margin portions 44 in the rear part of the upper are drawn downwardly and wrapped around the undersurface of the seat board and cemented in place as shown in FIG. 4. Seat board 38 has previously been secured to the reinforcing metal strip 46 by rivet 48 or cementing if the strip is to be used.

Next, the upper surface of the outsole 14 is primed and precoated with cement for curing. The priming operation includes roughening up the top surface 76 of the outsole or chemically treating that surface to remove the shiny surface left after molding. Such processing opens up the molded skin to allow the cement or adhesive to thoroughly penetrate the outsole surface for provision of a secure, tight bond to the shoe upper. Likewise, the outer surface of the upper bottom is roughened by rubbing a wire wheel against the leather surface to raise the fiber of the leather and allow the cement to penetrate when applied. Thereafter, each surface of the shoe upper and outsole to be placed together is precoated with a suitable adhesive cement compatible with leather and polyurethane and allowed to dry and cure typically over a period of 45 minutes or longer. After curing, the two shoe portions are pressed together and bonded in a press under heat and pressure, the heat activating the precoated adhesive. Simultaneously, any air pockets are eliminated or removed such that the resultant bond is tight and secure over the full length of the interface between the upper and outsole. When secured as described, memory pad 34 will press against the upper surface 76 of the outsole and protrude above the surrounding upper bottom 26 as shown in FIGS. 2, 3 and 8. When pressed together, the metal stiffening strip 46, if any, is received in recess 84 for proper location and retention. The final step is to remove the last from the forepart and heel and insert and adhere the insole 90 with air circulation holes 96 in registry over the memory pad 34 and over the heel area 36.

Figure 10:
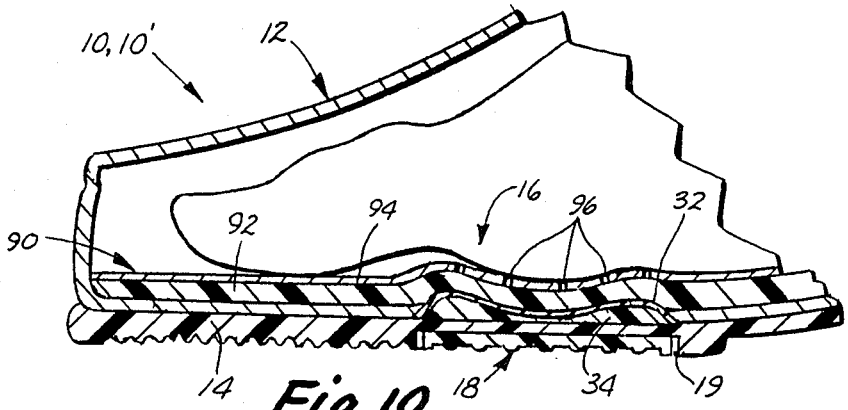
FIG. 10 is an enlarged, fragmentary, sectional side elevation of the shoe construction of the present invention showing a weight bearing foot in place in the forepart of the shoe.

With reference to FIGS. 10 and 11, use of the shoe construction of the present invention will be understood. When the foot is inserted into shoe 10 or 10' as shown in FIG. 10, the toes extend forwardly near the front of the forepart and engage the insole 90 in front of the metatarsal head support area and the location of memory pad 34 as shown. The metatarsal bone heads and the ball of the foot rest directly on the memory pad assembly. When body weight is applied to the foot during walking as shown in FIG. 10, the ball of the foot or metatarsal head support area presses downwardly on memory pad assembly 16 thereby compressing it to a thickness closely approximating that of the surrounding shoe upper bottom 26. The flush matching of the thickness of memory pad 34 and thin cover 32 with the surrounding upper bottom 26 as described above prevents the wearer from feeling any protrusion or lump under the ball of the foot during walking while likewise preventing the feel of any edge surrounding the memory pad 34 as was known in previous constructions. Therefore, all discomfort in use of the pad is prevented. When weight is removed from the foot, as shown in FIG. 3, the pad and cover spring back resiliently pushing the insole upwardly against the ball of the foot to provide support around the metatarsal bone heads. This provides a secure feeling of comfort for the wearer especially in the area of memory pad 34 under the metatarsal heads in the weight bearing area of the forepart of the foot.

Accordingly, the present invention provides a shoe construction with a soft, flexible forepart which cushions without discomfort when the shoe is worn either during walking or at rest. In addition, the inclusion of outsole pads 18, 20, with forward pad 18 being aligned and in registry with the memory pad 34, provide increased traction, wear resistance and cushioning since the separate nature of pads 18, 20 from the surrounding outsole portions allows them to stay in registry and proper supporting and gripping position even when the forepart of the outsole is flexed more radically such as during walking. It is also possible to form pads 18, 20 from a tougher, more wear resistant material than the surrounding outsole portion or from a different surface gripping material for increased traction. In any event, the metatarsal head support area as shown in FIG. 11 is securely and firmly supported with maximum comfort.

While several forms of the invention have been shown and described, other forms will now be apparent to those skilled in the art. The embodiments shown in the drawings and described above are merely for illustrative purposes and are not intended to limit the scope of the invention which is defined by the claims which follow.

The embodiments of the invention in which an exclusive property or privilege is claimed are defined as follows:

1. A shoe construction for the human foot comprising:

an outsole;

a shoe upper portion secured to said outsole and having a rear part adapted to extend along the sides and heel area of the foot and a forepart extending over and along the toes of the foot, said forepart extending downwardly and inwardly from said sides and toe areas and forming an upper bottom extending under the entire forepart and adapted to overlie said outsole, said upper portion also including an aperture in the bottom of said forepart in the area of said shoe adapted to support the metatarsal heads of the foot;

memory pad means formed from resilient compressible material in said aperture and engaging the upper surface of said outsole for supporting the metatarsal head area of the foot; and insole means overlying said upper bottom and memory pad means for supporting and engaging the foot;

said forepart bottom having a predetermined first thickness in the area surrounding said aperture; said memory pad means having a second thickness greater than said first thickness and projecting above said forepart bottom in said surrounding area when uncompressed, and being compressible by a foot to a third thickness substantially similar to said first thickness when the foot bears the body weight in said shoe.

2. The shoe construction of claim 1 wherein said memory pad means include a thin, flexible cover over said aperture, said cover being fastened to said upper bottom surrounding said aperture and supporting said upper bottom around said aperture; said memory pad being secured to the underside of said cover.

3. The shoe construction of claim 2 wherein said cover is a thin layer of woven material sewn to said upper bottom around the edge of said aperture.

4. The shoe construction of claim 3 wherein said cover is formed in two mating parts, one part being sewn to one side of said upper bottom in said aperture, the other part sewn to the other side of said upper bottom in said aperture, each cover part including a free edge butted to the other free edge and sewn together to form a unitary cover.

5. The shoe construction of claim 2 wherein said forepart of said upper portion is force lasted; the lower margins of said rear part extending downwardly and inwardly from said sides and joined together to form an upper bottom between said aperture and said heel area at the waist of said shoe.

6. The shoe construction of claim 2 wherein said forepart of said upper portion is force lasted; said rear part being cement lasted and including a seat board of stiff material and lower margins along said sides and heel area of said rear part wrapped around and cemented to the underside of said seat board.

7. The shoe construction of claim 6 including a stiffening member secured to said underside of said seat board and extending from said heel area to a position spaced rearwardly of said aperture.

8. The shoe construction of claim 7 wherein said stiffening member is riveted to said seat board at said heel area at its rear end and cemented to said seat board at its forward end.

9. The shoe construction of claim 7 wherein said outsole includes a recess on its upper surface for locating and resisting movement of said stiffening member.

10. The shoe construction of claim 6 wherein said insole means includes a first layer of resilient, flexible foam material extending the full length of said upper portion and a second, thin, sock liner layer overtop said first foam layer.

11. The shoe construction of claim 10 wherein said insole means also includes a third layer at said heel area, said third layer being another layer of resilient, flexible foam material adhered to the underside of said first foam layer at said heel area.

12. The shoe construction of claim 10 wherein said second sock liner layer is formed from leather and includes a plurality of air circulation holes therethrough at said metatarsal head area and at said heel area.

13. The shoe construction of claim 10 wherein said outsole includes first pad means in the bottom surface thereof below said metatarsal head support area for improving traction, gripping and wear resistance during walking when the shoe is worn while cushioning the impact of the foot on objects under said outsole.

14. The shoe construction of claim 13 wherein said outsole also includes second pad means in said bottom surface at said heel area of said shoe.

15. The shoe construction of claim 14 wherein said first and second pads include first and second preformed inserts of molded thermoplastic rubber having a first predetermined tread configuration, the remainder of said outsole being molded around said inserts from thermoplastic rubber such that said tread configuration is exposed at the bottom of said outsole.

16. The shoe configuration of claim 15 wherein said first and second preformed inserts are both formed from the same thermoplastic rubber as said remainder of said outsole and are spaced slightly from the surrounding portions of said outsole, the front area of said outsole ahead of said first insert including a second predetermined tread configuration.

17. The shoe configuration of claim 16 wherein said first tread configuration includes a plurality of partially spherical protrusions forming a pebble-grain surface; said second tread configuration including a plurality of parallel ridges extending laterally across said outsole bottom surface and forming a shallow ripple-sole surface.

18. The shoe construction of claim 1 wherein said forepart of said upper portion is force lasted; said rear part including a seat board of stiff material and lower margins along said sides and heel area of said rear part wrapped around and cement lasted to the underside of said seat board.

19. The shoe construction of claim 1 wherein said insole means includes a first layer of resilient, flexible foam material extending the full length of said upper portion and a second, thin, sock liner layer overtop said first foam layer.

20. The shoe construction of claim 1 wherein said outsole includes first pad means in the bottom surface thereof below said metatarsal head support area for improving traction, gripping and wear resistance during walking when the shoe is worn while cushioning the impact of the foot on objects under said outsole.

21. The shoe construction of claim 20 wherein said outsole also includes second pad means in said bottom surface at said heel area of said shoe.

22. A shoe construction for the human foot comprising:

an outsole;

a force lasted upper portion secured to said outsole and having a forepart, a rear part and an upper bottom in at least said forepart;

an aperture in said forepart upper bottom in the area adapted to support said metatarsal heads of the foot;

a thin, flexible cover over said aperture, said cover being fastened to said upper bottom surrounding said aperture, said cover supporting said upper bottom around said aperture during force lasting; and a resilient memory pad in said aperture, said memory pad being secured to the underside of said thin cover and engaging the upper surface of said outsole for supporting the metatarsal head area of the foot;

said memory pad and thin cover adapted to compress to the thickness of said upper bottom surrounding said aperture when supporting the body weight on the foot.

23. The shoe construction of claim 22 wherein said cover is a thin layer of woven material sewn to said upper bottom around the edge of said aperture.

24. The shoe construction of claim 23 wherein said cover is formed in two mating parts, one part being sewn to one side of said upper bottom in said aperture, the other part sewn to the other side of said upper bottom in said aperture, each cover part including a free edge butted to the other free edge and sewn together to form a unitary cover.

25. The shoe construction of claim 22 wherein said rear part includes a seat board of stiff material and lower margins along said sides and heel area of said rear part wrapped around and cement lasted to the underside of said seat board.

26. The shoe construction of claim 25 including a stiffening member secured to said underside of said seat board and extending from said heel area to a position spaced rearwardly of said aperture.

27. The shoe construction of claim 26 wherein said outsole includes a recess on its upper surface for locating and resisting movement of said stiffening member.

28. The shoe construction of claim 22 including insole means having a first layer of resilient, flexible foam material extending the full length of said upper portion and a second, thin, sock liner layer overtop said first foam layer.

29. The shoe construction of claim 22 wherein said outsole includes first pad means in the bottom surface thereof below said metatarsal head support area for improving traction, gripping and wear resistance during walking when the shoe is worn while cushioning the impact of the foot on objects under said outsole.

30. The shoe construction of claim 29 wherein said outsole also includes second pad means in said bottom surface at said heel area of said shoe.

31. A shoe construction for the human foot comprising:

an outsole;

a force lasted upper portion secured to said outsole and having a forepart, a rear part and an upper bottom in at least said forepart;

memory pad means extending through said forepart upper bottom for supporting the metatarsal heads of the foot, said memory pad means engaging the upper surface of said outsole; and first outsole pad means in the bottom surface of said outsole below said memory pad means for improving traction, gripping and wear resistance during walking when the shoe is worn while cushioning the impact of the foot on objects under said outsole.

32. The shoe construction of claim 31 wherein said outsole also includes second pad means in said bottom surface at said heel area of said shoe.

33. The shoe construction of claim 32 wherein said first and second outsole pad means include a first tread configuration different from the tread configuration on the remainder of said forward part of said outsole bottom surface.

34. The shoe construction of claim 32 wherein said first and second pads include first and second preformed inserts of molded thermoplastic rubber having a first predetermined tread configuration, the remainder of said outsole being molded around said inserts from thermoplastic rubber such that said tread configuration is exposed at the bottom of said outsole.

35. The shoe configuration of claim 34 wherein said first and second preformed inserts are both formed from the same thermoplastic rubber as said remainder of said outsole and are spaced slightly from the surrounding portions of said outsole.

36. The shoe configuration of claim 35 wherein said first tread configuration includes a plurality of partially spherical protrusions forming a pebble-grain surface; said second tread configuration including a plurality of parallel ridges extending laterally across said outsole bottom surface and forming a shallow ripple-sole surface.

37. The shoe construction of claim 31 wherein said rear part extends along the sides and heel area of the foot and said forepart extends over and along the toes of the foot, said forepart extending downwardly and inwardly from said sides and toe areas and forming an upper bottom extending under the entire forepart and overlying said outsole, said upper portion also including an aperture in the upper bottom of said forepart in the area of said shoe adapted to support the metatarsal heads of the foot; said memory pad means extending through said aperture.

38. The shoe construction of claim 37 wherein said memory pad means include a thin, flexible cover over said aperture, said cover being fastened to said upper bottom surrounding said aperture, said cover supporting said upper bottom around said aperture; and a memory pad formed from resilient, compressible foam material secured to the underside of said cover.

39. The shoe construction of claim 38 wherein said rear part includes a seat board of stiff material and lower margins along said sides and heel area of said rear part wrapped around and cement lasted to the underside of said seat board.

40. The shoe construction of claim 39 including a stiffening member secured to said underside of said seat board and extending from said heel area to a position spaced rearwardly of said memory pad means.

41. The shoe construction of claim 39 including insole means having a first layer of resilient, flexible foam material extending the full length of said upper portion and a second, thin, sock liner layer overtop said first foam layer.

42. A shoe construction for the human foot comprising:

an outsole;

a shoe upper portion secured to said outsole and including a forepart and a rear part, said forepart including sides which wrap around and under the toes and metatarsal head area of the foot to form an upper bottom which overlies said outsole;

said upper bottom of said forepart including an aperture therethrough in the area of said shoe adapted to support the metatarsal heads of the foot;

memory pad means formed from resilient compressible material in said aperture and engaging the upper surface of said outsole for supporting the metatarsal head area of the foot;

outsole pad means positioned in the bottom surface of said outsole generally in alignment with said memory pad means for improving traction, gripping and wear resistance while the shoe is worn and for cushioning the impact and pressure of objects under the metatarsal head area of the foot when walking.

43. The shoe construction of claim 42 wherein said outsole pad means underlies and has a configuration generally comparable to that of said overlying, generally aligned memory pad means.

* * * * *

UNITED STATES PATENT AND TRADEMARK OFFICE

CERTIFICATE OF CORRECTION

PATENT NO. : 4,866,860

DATED : September 19, 1989

INVENTOR(S) : Malcolm G. Blissett and Brian C. Goodliffe

It is certified that error appears in the above-identified patent and that said Letters Patent is hereby corrected as shown below:

Abstract, Line 12;
"outside" should be -- outsole --;

Column 1, Line 25;
"matatarsal" should be -- metatarsal --;

Column 6, Line 10;
"fromed" should be -- formed --.

Signed and Sealed this

Eighth Day of January, 1991

*Attest:*

HARRY F. MANBECK, JR.

*Attesting Officer*

*Commissioner of Patents and Trademarks*